US006104142A

United States Patent [19]

Zuchtriegel

[11] Patent Number: 6,104,142

[45] Date of Patent: Aug. 15, 2000

[54] CIRCUIT ARRANGEMENT FOR OPERATING LOW-PRESSURE DISCHARGE LAMPS

[75] Inventor: Anton Zuchtriegel, Taufkirchen, Germany

[73] Assignee: Patent-Treuhand-Gesellschaft fuer elektrische Gluehlampen mbH, Munich, Germany

[21] Appl. No.: 09/285,540

[22] Filed: Apr. 2, 1999

[30] Foreign Application Priority Data

Apr. 7, 1998 [DE] Germany ..... 198 15 623

[51] Int. Cl.[7] ..... H05B 37/02

[52] U.S. Cl. ..... 315/209 R; 315/219; 315/224; 315/244

[58] Field of Search ..... 315/224, 219, 315/205, 209 R, 244, 247, DIG. 7, 225, 308

[56] References Cited

U.S. PATENT DOCUMENTS

| | | | |
|---|---|---|---|
| 4,808,887 | 2/1989 | Fahnrich et al. | 315/224 |
| 5,574,336 | 11/1996 | Konopka et al. | 315/225 |
| 5,583,399 | 12/1996 | Rudolph | 315/225 |
| 5,610,479 | 3/1997 | Schmitt | 315/209 R |
| 5,677,601 | 10/1997 | Zuchtriegel | 315/209 R |
| 5,801,492 | 9/1998 | Bobel | 315/224 |
| 5,898,278 | 4/1999 | Muessli | 315/219 |
| 5,994,847 | 11/1999 | Konopka | 315/219 |

*Primary Examiner*—Don Wong
*Assistant Examiner*—Wilson Lee
*Attorney, Agent, or Firm*—Carlo S. Bessone

[57] ABSTRACT

In the circuit arrangement for the high-frequency operation of a low-power low-pressure discharge lamp (LP) having a mains rectifier (2) and a half-bridge circuit, a diode (D1) is connected in series and in the DC non-conducting direction in the connecting line between the second electrode (E2) of the lamp (LP) and the positive or negative pole of the rectifier (2). Moreover, the tap (M2) between the diode (D1) and the second electrode (E2) is connected to the other pole of the mains rectifier (2) via a capacitor (C1), and a resistor (R9) is connected in parallel with the diode (D1). The circuit thus created acts as a passive harmonic filter which fulfills for the circuit arrangement the IEC regulations of class D with reference to line current harmonic content.

4 Claims, 4 Drawing Sheets

CIRCUIT ARRANGEMENT FOR OPERATING LOW-PRESSURE DISCHARGE LAMPS

FIELD OF THE INVENTION

The invention relates to a circuit arrangement for the high-frequency operation of a low-power low-pressure discharge lamp.

BACKGROUND OF THE INVENTION

The disadvantage of this circuit arrangement is that harmonics are produced in the network by the half-bridge circuit and the DC link capacitor required with such switched-mode power supplies. In accordance with IEC Publication 555-2, this line current harmonic content must, from 1996, fulfill Class C of the regulations for ballasts or converters with a power consumption of greater than 25 W, and, from 1998, Class D of the regulations for compact lamps, ballasts and adapters with a power consumption of less than or equal to 25 W.

Since the magnitude of the DC link capacitor is proportional to the power consumption of the lamp, ballasts for lamps of greater than 25 W require DC link capacitors with relatively high capacitances. However, the latter entail a high harmonic content, with the result that these lamps require active harmonic filter circuits in the form of complicated pumping circuits with capacitors and diodes in order to be able to fulfill the IEC regulations of Class C. Such a circuit arrangement is described, for example, in DE-A 36 23 749. Moreover, these active circuits entail additional radio interference which can only be suppressed with a high outlay on components.

It is the object of the invention to create a circuit arrangement for operating low-power low-pressure discharge lamps, that is to say those of less than or equal to 25 W, which keeps the line current harmonic content below the maximum values laid down in Class D of the IEC publications. The circuits outlay required for this purpose should be as low as possible and be capable of being implemented cost-effectively.

DE 44 30 397 has disclosed a circuit arrangement which keeps the harmonic content below the maximum value laid down in Class D of the IEC publications, and requires three capacitors (with the DC link capacitor) and two diodes to create a low-capacitance DC link.

SUMMARY OF THE INVENTION

The object here was to create a further simplified circuit arrangement which includes the prescribed limiting values for the harmonics and manages with even fewer components.

The harmonic filter circuit according to the invention which comprises only one diode and only one capacitor in addition to the DC link capacitor achieves reliable operation of the half-bridge generator in the zero crossing of the sinusoidal line voltage. Unlike the abovementioned pumping circuits, the circuit operates not actively, but passively, with the result that only slight radio interference occurs, and the outlay on components for radio interference suppression can be kept low. Moreover the circuit manages with relatively low capacitance values in the DC link. Consequently, cost-effective foil capacitors can be used as DC link capacitor.

A high power factor (ratio of active power to apparent power) of greater than or equal to 0.9 results by virtue of the low charging capacitance of the DC link capacitor and the coupling according to the invention of one lamp side to the circuit according to the invention for harmonic filtering.

The harmonic filter circuit composed of a diode and a capacitor can be implemented cost-effectively in a small space, since it is likewise possible to use as capacitors foil capacitors which have a higher "long term temperature stability" in addition (by comparison with electrolytic capacitors).

The harmonic filter circuit also renders it possible to economize on the coupling capacitor in series with the resonance inductor in the series resonant circuit, since the capacitor of the harmonic filter circuit also takes over the task of the coupling capacitor.

BRIEF DESCRIPTION OF THE DRAWINGS

The invention will be explained in more detail with the aid of the following figures, in which.

BEST MODE FOR CARRYING OUT THE INVENTION

Figure 1:
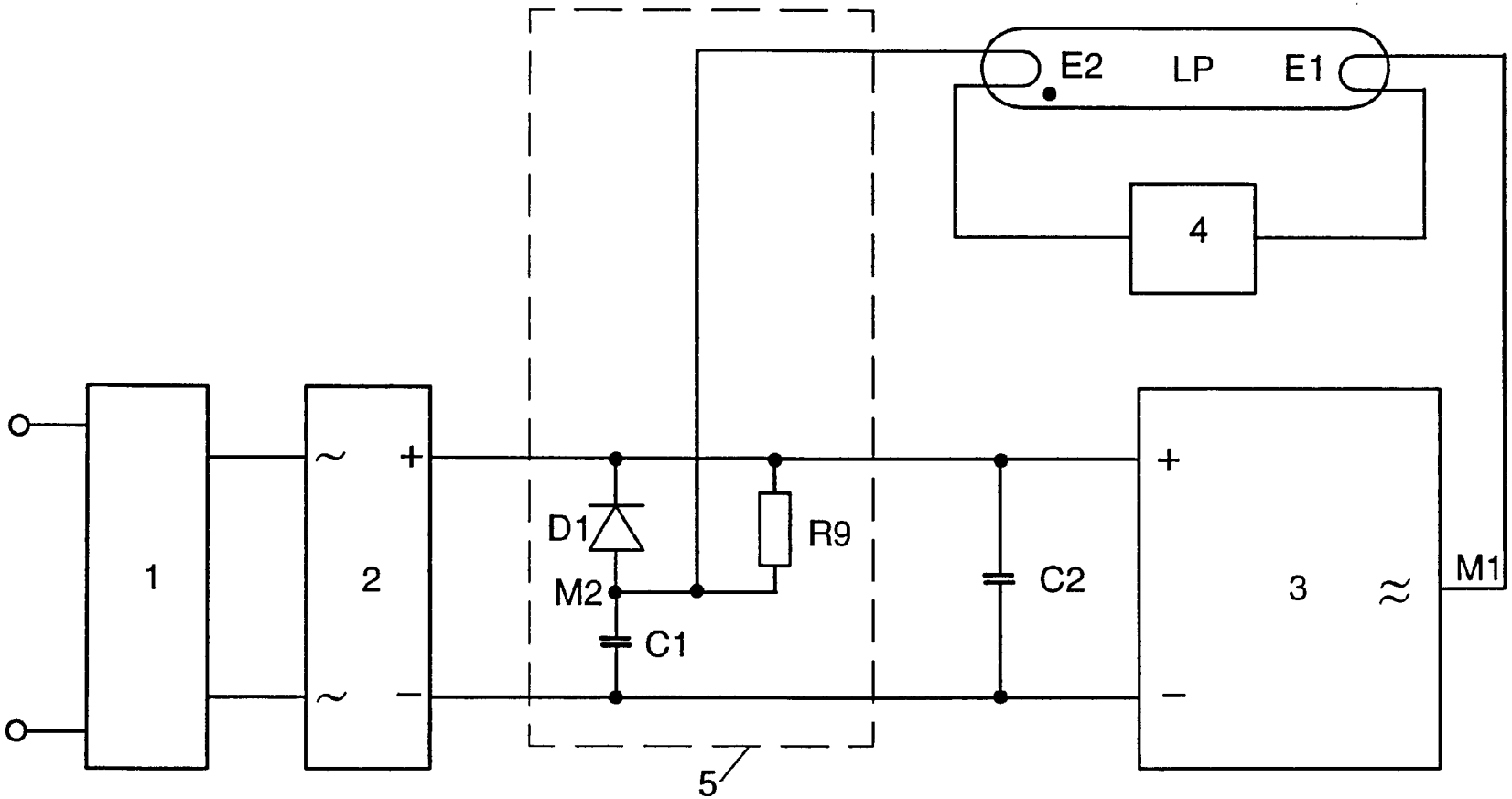
FIG. 1 shows the block diagram of a circuit arrangement with a harmonic filter for a low-power low-pressure discharge lamp.

The block diagram in FIG. 1 reproduces the design principle of a circuit arrangement according to the invention for a low-power low-pressure discharge lamp LP. The circuit arrangement comprises a radio interference suppression filter 1, a mains rectifier 2 and a half-bridge generator 3 with a drive circuit and resonance inductor. Connected between the center tap of the two transistors of the half-bridge generator 3 and the positive pole of the mains rectifier 2 is the low-pressure discharge lamp LP, the preheating circuit 4 being connected in parallel with the lamp LP.

According to the invention, the circuit arrangement additionally has a harmonic filter circuit 5, a diode D1 being connected in series and in the DC non-conducting direction in the connection between the positive pole of the mains rectifier 2 and the second electrode E2 of the low-pressure discharge lamp LP. Moreover, the tap M2 between the diode D1 and the second electrode E2 is connected via a capacitor C1 to the negative pole of the mains rectifier 2. A resistor R9 is, moreover, connected in parallel with the diode D1. The DC link capacitor C2 is connected in parallel with the DC output of the mains rectifier in the case of this block diagram.

Figure 2:
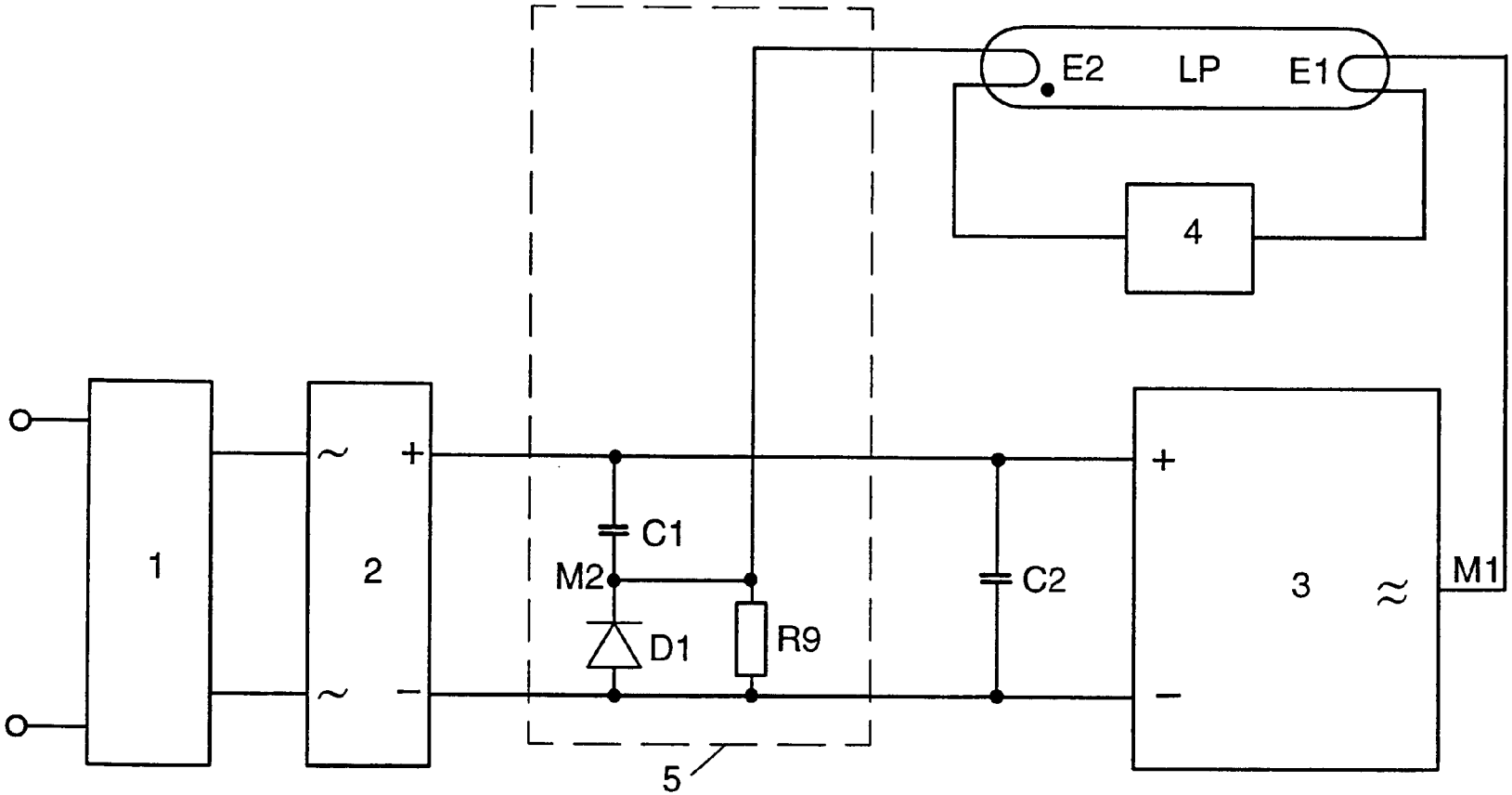
FIG. 2 shows a variant of the block diagram of a circuit arrangement in accordance with FIG. 1.

FIG. 2 shows a possible variant of the block diagram as it is represented in FIG. 1. Here, the negative pole of the mains rectifier 2 is connected to the second electrode E2 of the lamp LP via a diode D1 in the DC non-conducting direction (referred to the positive pole). The tap M2 between the diode D1 and the second electrode E2 is connected to the positive pole of the mains rectifier 2 via a capacitor C1. A resistor R9 is also connected in parallel here to the diode D1.

Figure 3:
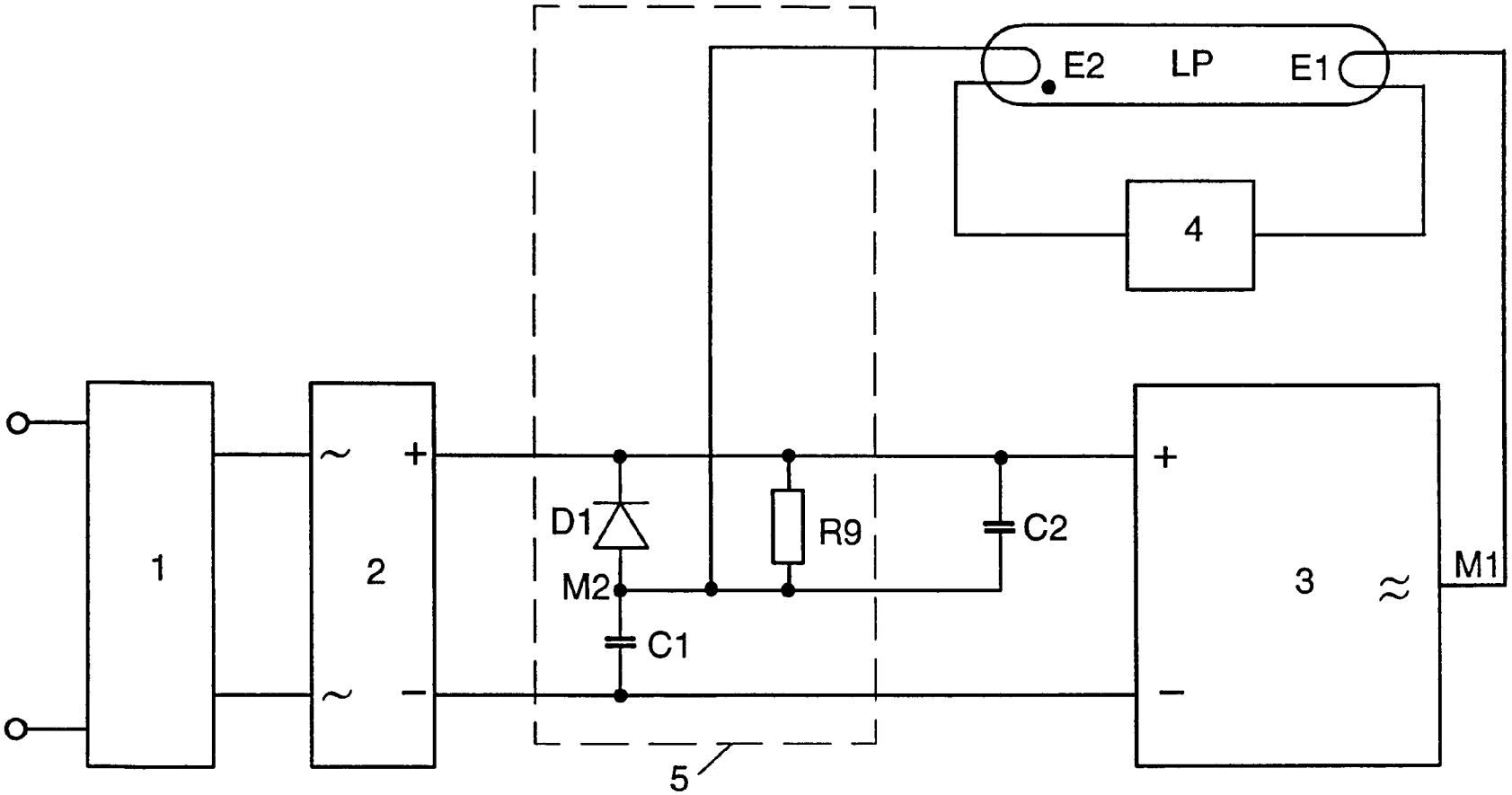
FIG. 3 shows a further variant of the block diagram of a circuit arrangement in accordance with FIG. 1.

The variant in FIG. 3 corresponds essentially to the block diagram in FIG. 1. However, the DC link capacitor C2 is connected here not in parallel with the DC output of the mains rectifier 2, but in parallel with the diode D1.

Figure 4:
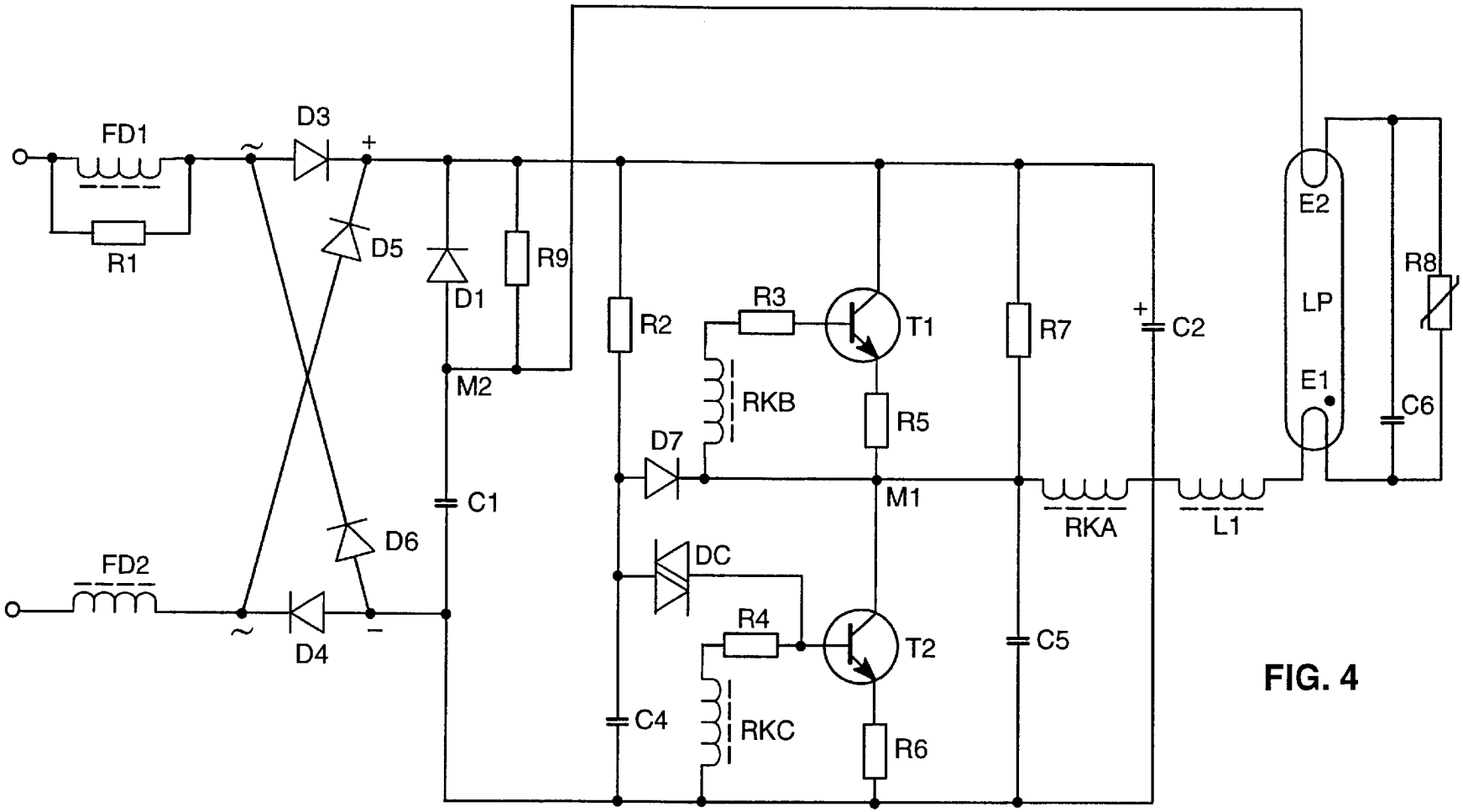
FIG. 4 shows the detailed circuit diagram of a circuit arrangement in accordance with FIG. 1.

FIG. 4 shows an accurate circuit diagram of the circuit arrangement according to the invention with a harmonic filter circuit for operating a low-pressure discharge lamp LP in accordance with the block diagram in FIG. 1. Directly at the mains input, a filter inductor FD1, FD2 is connected in each supply lead, and a resistor R1 is connected in parallel with the filter inductor FD1. Downstream of this high-frequency filter is the mains rectifier with the diodes D3 to D6. The self-controlling half-bridge circuit comprises the two transistors T1, T2, the series resistors R3 to R6, the control transformer and the start-up generator with the resistors R2, R7, the starting capacitor C4, the diode D7 and the diac DC. The control transformer operates according to the feedback principle and is assembled from the primary winding RKA and the two secondary windings RKB and RKC. The lamp LP is connected with a terminal of the electrode E1 to the center tap M1 between the two transistors T1, T2, and with a terminal of the other electrode E2 to the positive pole of the mains rectifier. Moreover, a series resonant circuit composed of a resonance inductor L1 and resonance capacitor C6 is provided, the resonance inductor L1 being connected between the primary winding RKA of the control transformer and the corresponding terminal of the electrode E1, and the resonance capacitor C6 being connected between the terminals, situated on the side of the heating circuit, of the electrodes E1 and E2. Moreover, a DC link capacitor C2 is connected in parallel with the switching paths of the transistors T1, T2. The capacitor C5 in parallel with the switching path of the transistor T1 serves the purpose of radio frequency suppression (trapezoidal capacitor). Moreover, a PTC thermistor R8 is connected in parallel with the resonance capacitor C6 in order to improve the preheating.

The mode of operation of such a circuit arrangement with a half-bridge circuit and series resonant circuit for igniting and operating a low-pressure discharge lamp can be gathered from the book entitled "Elektronikschaltungen" ("Electronic circuits") by W. Hirschmann (SIEMENS AG) 1982, page 148, and will not be set forth here in more detail.

The additional harmonic filter circuit comprises the diode D1, which is connected in series and in the DC non-conducting direction between the positive pole of the mains rectifier and the corresponding terminal of the electrode E2 of the low-pressure discharge lamp LP. The tap M2 between the diode D1 and the electrode E2 is connected via a capacitor C1 to the negative pole of the mains rectifier. Moreover, a resistor R9 is connected in parallel with the diode D1.

The capacitor C1 is charged via the lamp circuit. The charging of the support capacitor C1 is directed via the diode D1 onto the DC link, and then ensures together with the charging of the DC link capacitor C2 that even in the case of zero crossing of the AC supply voltage there is a sufficiently high supply voltage to keep the half-bridge circuit operating. The capacitor C1 thus acts simultaneously as a coupling capacitor, with the result that it is possible to dispense with a dedicated coupling capacitor. The resistor R9 in parallel with the diode D1 stabilizes the oscillatory characteristics of the half-bridge circuit.

The circuit elements used for a circuit arrangement in accordance with FIG. 4 for operating an 8 W fluorescent lamp LP from a 230 V AC voltage are summarized in the following list of components:

| | |
|---|---|
| FD1, FD2 | 1.5 mH, BC |
| D3–D6 | Rectifier bridge circuit B250 C800 |
| D1, D7 | 1N4005 |
| C1 | 1 μF |
| C2 | 0.22 μF |
| C4 | 0.1 μF |
| C5 | 1.5 nF |
| C6 | 4.7 nF |
| DC | Diac 1N413M |
| R1 | 10 kΩ |
| R2, R7 | 820 kΩ |
| R3, R4 | 22 Ω |
| R5, R6 | 1 Ω |
| R8 | PTC thermistor PTC-C1380 |
| R9 | 270 Ω |
| RKA | 9 turns |
| RKB, RKC | 3 turns |
| L1 | 2.4 mH, EF16 |
| T1, T2 | BUD 620 |

What is claimed is:

1. A circuit arrangement for the high-frequency operation of a low-power low-pressure discharge lamp (LP) from an AC voltage source, the circuit arrangement having the following features:

a mains rectifier (2) with a downstream DC link capacitor (C2), a half-bridge circuit which is connected to the DC output of the mains rectifier (2) and has two alternately switching transistors (T1,T2) and a drive circuit, a center tap (M1) being provided between the two transistors (T1,T2), a series resonant circuit which is assigned to the low-pressure discharge lamp (LP) and comprises a resonance inductor (L1) and a resonance capacitor (C6), connecting lines for the low-pressure discharge lamp (LP), a line connecting the first electrode (E1) of the lamp (LP) via the resonance inductor (L1) to the center tap (M1) between the two transistors (T1,T2), and in each case a further line connecting the second electrode (E2) of the lamp (LP) to the positive or negative pole of the mains rectifier (2), wherein a diode (D1) is connected in series and in the DC non-conducting direction in the connecting line between the second electrode (E2) of the lamp (LP) and the positive or negative pole of the mains rectifier (2), and a tap (M2) between the diode (D1) and a direct connection to the second electrode (E2) is connected via a capacitor (C1) to the other pole of the mains rectifier (2).

2. The circuit arrangement as claimed in claim 1, wherein a resistor (R9) is connected in parallel with the diode (D1).

3. The circuit arrangement as claimed in claim 1, wherein the DC link capacitor (C2) is connected in parallel with the DC output of the mains rectifier (2).

4. The circuit arrangement as claimed in claim 1, wherein the DC link capacitor (C2) is directly connected in parallel with the diode (D1).

* * * * *